US010248062B1

(12) United States Patent
Able et al.

(10) Patent No.: US 10,248,062 B1
(45) Date of Patent: Apr. 2, 2019

(54) SYSTEM AND METHODS FOR ADJUSTING TONER DENSITY IN AN IMAGING DEVICE

(71) Applicant: LEXMARK INTERNATIONAL, INC., Lexington, KY (US)

(72) Inventors: Douglas Anthony Able, Shelbyville, KY (US); Michael Brian Bacalieri, Lexington, KY (US); Andrew Gil Montaño Desabelle, Cebu (PH); Gary Scott Overall, Lexington, KY (US); Marvin Aliviado Rodriguez, Cebu (PH)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/795,580

(22) Filed: Oct. 27, 2017

(51) Int. Cl.
*G03G 15/00* (2006.01)

(52) U.S. Cl.
CPC ..... *G03G 15/5041* (2013.01); *G03G 15/556* (2013.01); *G03G 2215/00067* (2013.01); *G03G 2215/00616* (2013.01)

(58) Field of Classification Search
CPC ..... G03G 15/5058; G03G 15/5041; G03G 15/556; G03G 15/5062; G03G 15/5054
USPC ..... 399/49
See application file for complete search history.

(56) References Cited

U.S. PATENT DOCUMENTS

| | | | |
|---|---|---|---|
| 6,463,227 | B1 | 10/2002 | Denton et al. |
| 6,813,470 | B1 | 11/2004 | Elbert et al. |
| 6,980,767 | B1 | 12/2005 | Cahill et al. |
| 7,044,573 | B2 | 5/2006 | King et al. |
| 7,122,800 | B2 | 10/2006 | Barry et al. |
| 7,769,306 | B2 | 8/2010 | Able et al. |
| 7,778,559 | B2 | 8/2010 | Omelchenko |
| 7,995,939 | B2 | 8/2011 | Carter, Jr. et al. |

*Primary Examiner* — Walter L Lindsay, Jr.
*Assistant Examiner* — Frederick Wenderoth

(57) ABSTRACT

An electrophotographic imaging device having a method of printing which includes setting a default toner density for printing; developing a first toned image having the default toner density; printing the first toned image on a first page of a print job; and before printing a second page of a print job, determining whether a duty cycle state of a photoconductive member in the imaging device has changed, and upon a positive determination, developing a second toned image having a toner density derived from the default toner density and printing the second toned image on the second page.

20 Claims, 3 Drawing Sheets

SYSTEM AND METHODS FOR ADJUSTING TONER DENSITY IN AN IMAGING DEVICE

CROSS REFERENCE TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Technical Field

The present invention relates generally to toner density calibration methods, and more particularly to, methods for performing toner density calibrations based on duty cycle state changes in an imaging device.

2. Description of the Related Art

It is common in the imaging space for electrophotographic imaging devices to use a toner density sensor (TDS) to measure an optical reflectance of specific toner patches and to provide feedback to a controller of each imaging device on how to more accurately develop toner at the desired darkness level on a printed media sheet page. In performing a toner density calibration process, particular amounts of toner from the replaceable cartridge supply are developed as patches onto a photoconductive drum (or another intermediate transfer member) and are considered toner waste following the calibration process. Some amounts of toner are thus spent to be able to provide feedback to the controller and properly set an amount of toner on succeeding media sheets to achieve a substantially consistent level of darkness on the printed media. However, waste toners can impact loading capacities of a given toner cartridge, and depending on how the waste toners are stored in the imaging system, waste toners may lower a claimed allowable life of the imaging unit. It is also usual for toner density calibration algorithms to be performed following every power on reset of the imaging device or every predetermined number of pages.

Accordingly, it is desired to have more efficient algorithms in performing toner density calibrations such that a minimal amount of toner is being wasted. There also exists a need for methods in triggering said calibrations based on need.

SUMMARY

An imaging system including an electrophotographic imaging device and methods for adjusting toner density for use in printing in the imaging device are disclosed.

One example embodiment for a method of printing in an imaging device includes setting a default toner density for printing; developing a first toned image having the default toner density; printing the first toned image on a first page of a print job; and before printing a second page of a print job: determining whether a duty cycle state of a photoconductive member in the imaging device has changed; and upon a positive determination, developing a second toned image having a toner density derived from the default toner density and printing the second toned image on the second page.

Another example embodiment includes an electrophotographic imaging device performing a method of printing, the method including determining a default toner density; printing a first print job page having a toned image developed by applying the default toner density; and for each print job page following the first print job page: detecting a change in a duty cycle state of a photoconductive member in the imaging device; adjusting the default toner density in response to the change in the duty cycle state; and printing an image associated with a next print job page developed using the adjusted toner density.

Other embodiments, objects, features and advantages of the disclosure will become apparent to those skilled in the art from the detailed description, the accompanying drawings and the appended claims.

BRIEF DESCRIPTION OF THE DRAWINGS

The above-mentioned and other features and advantages of the present disclosure, and the manner of attaining them, will become more apparent and will be better understood by reference to the following description of example embodiments taken in conjunction with the accompanying drawings. Like reference numerals are used to indicate the same element throughout the specification.

DETAILED DESCRIPTION OF THE DRAWINGS

Figure 1:
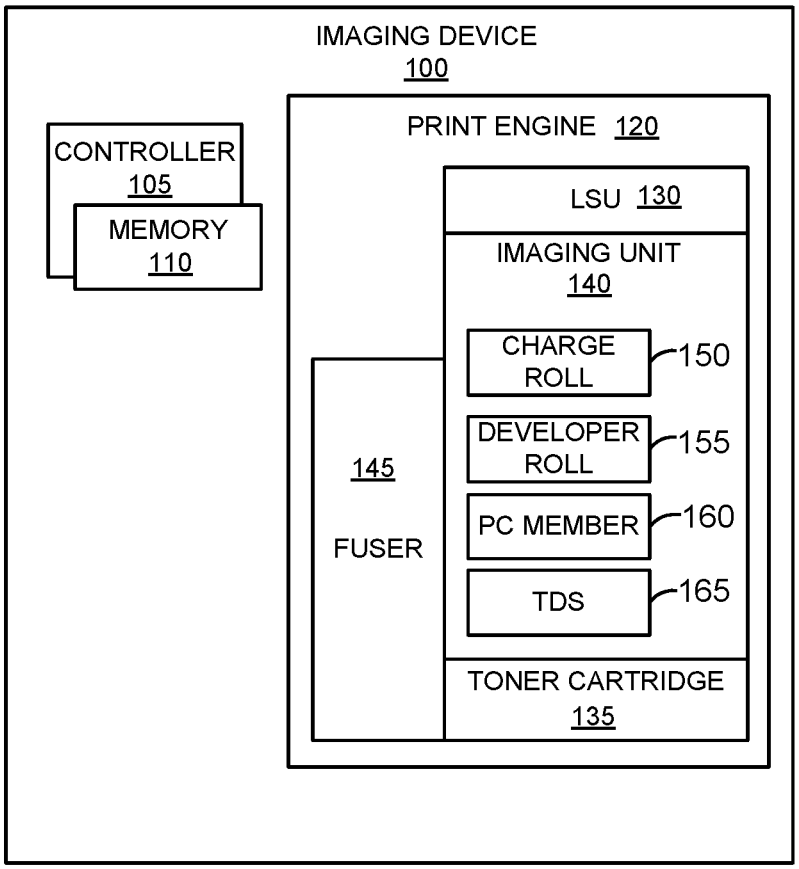
FIG. 1 is a block diagram of an electrophotographic imaging device, according to one example embodiment.

It is to be understood that the disclosure is not limited to the details of construction and the arrangement of components set forth in the following description or illustrated in the drawings. The disclosure is capable of other example embodiments and of being practiced or of being carried out in various ways. For example, other example embodiments may incorporate structural, chronological, process, and other changes. Examples merely typify possible variations. Individual components and functions are optional unless explicitly required, and the sequence of operations may vary. Portions and features of some example embodiments may be included in or substituted for those of others. The scope of the disclosure encompasses the appended claims and all available equivalents. The following description is therefore, not to be taken in a limited sense, and the scope of the present disclosure is defined by the appended claims.

Also, it is to be understood that the phraseology and terminology used herein is for the purpose of description and should not be regarded as limiting. The use herein of "including", "comprising", or "having" and variations thereof is meant to encompass the items listed thereafter and equivalents thereof as well as additional items. Further, the use of the terms "a" and "an" herein do not denote a limitation of quantity but rather denote the presence of at least one of the referenced item.

In addition, it should be understood that example embodiments of the disclosure include both hardware and electronic components or modules that, for purposes of discussion, may be illustrated and described as if the majority of the components were implemented solely in hardware.

It will be further understood that each block of the diagrams, and combinations of blocks in the diagrams, respectively, may be implemented by computer program instructions. These computer program instructions may be loaded onto a general purpose computer, special purpose computer, or other programmable data processing apparatus to produce a machine, such that the instructions which execute on the computer or other data processing apparatus may create means for implementing the functionality of each block or combinations of blocks in the diagrams discussed in detail in the description below.

These computer program instructions may also be stored in a non-transitory computer-readable medium that may direct a computer or other programmable data processing apparatus to function in a particular manner, such that the instructions stored in the computer-readable medium may produce an article of manufacture, including an instruction means that implements the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions specified in the block or blocks.

Accordingly, blocks of the diagrams support combinations of means for performing the specified functions, combinations of steps for performing the specified functions, and program instruction means for performing the specified functions. It will also be understood that each block of the diagrams, and combinations of blocks in the diagrams, can be implemented by special purpose hardware-based computer systems that perform the specified functions or steps, or combinations of special purpose hardware and computer instructions.

Disclosed is an example imaging device and different example methods for adjusting toner density in an imaging device based on duty cycle state changes. For purposes of the present disclosure, the term "duty cycle state" refers to a general state of components in a toner development or imaging unit throughout a period of time the imaging device has been operating. The disclosed methods include an example method for performing one or more toner density calibrations in the imaging device and another example method for adjusting operating parameters applied in performing the toner density calibration(s).

FIG. 1 is a block diagram of an electrophotographic imaging device 100, according to one example embodiment. Imaging device 100 may be a single function printer or a multifunction machine (sometimes referred to as an all-in-one device) capable of printing, scanning, making copies, and/or other functionalities. As shown in FIG. 1, imaging device 100 includes a controller 105 having an associated electronic memory 110 and a print engine 120 each communicatively connected to controller 105 as is typical for imaging devices. Print engine 120 includes a laser scanning unit (LSU) 130, a toner cartridge 135, an imaging unit 140, and a fuser 145. Imaging unit 140 includes a charge roll 150, a developer roll 155, a photoconductive (PC) drum or member 160, and a toner density sensor 165. Imaging device 100 further includes a media feed system (not shown) including a media input area, a plurality of media feed rolls for forming feed nips and guiding media sheets along a media path within imaging device 100, and a media output area for receiving a printed media sheet.

While not shown, imaging device 100 may be communicatively connected to a client device such as a workstation computer or other mobile devices. Imaging device 100 and the client device may be communicatively connected via a communications link. As used herein, the term "communications link" generally refers to any structure that facilitates electronic communication between multiple components and may operate using wired or wireless technology and may include communications over the Internet. The communications link may be a standard communication protocol, such as, for example, universal serial bus (USB), Ethernet or IEEE 802.xx.

Each client device may include a software program including program instructions that function as an imaging driver, e.g., printer/scanner driver software, for imaging device 100. The imaging driver facilitates communications between imaging device 100 and the client device. One aspect of the imaging driver may be, for example, to provide formatted print data to imaging device 100 and, more particularly, to print engine 120 for printing an image. In some circumstances, it may be desirable to operate imaging device 100 in a standalone mode, such that all or a portion of an imaging driver in a client device, or a similar driver, may be located in controller 105 of imaging device 100 so as to accommodate printing and/or scanning functionality when operating in the standalone mode.

In addition to associated electronic memory 110, controller 105 includes a processor (not shown). The processor may include one or more integrated circuits in the form of a microprocessor or central processing unit and may be formed as one or more Application-Specific Integrated Circuits (ASICs). Memory 110 may be any volatile or non-volatile memory or combination thereof such as, for example, random access memory (RAM), read only memory (ROM), flash memory and/or non-volatile RAM (NVRAM). Alternatively, memory 110 may be in the form of a separate memory (e.g., RAM, ROM, and/or NVRAM), a hard drive, a CD or DVD drive, or any memory device convenient for use with controller 105. Controller 105 may be, for example, a combined printer and scanner controller.

Toner cartridge 135 and imaging unit 140 may be separately removable from print engine 120. When imaging unit 140 and toner cartridge 135 are mounted within imaging device 100, an outlet port on toner cartridge 135 communicates with an inlet port on imaging unit 140 to allow toner transfer. While not shown, toner cartridge 135, imaging unit 140, and fuser 145 each includes a processing circuitry and associated electronic memory which may provide authentication functions, safety and operational interlocks, operating parameters and usage information related to toner cartridge 135, imaging unit 140, and fuser 145. Respective processing circuitries of toner cartridge 135, imaging unit 140, and fuser 145 may include one or more integrated circuits in the form of a microprocessor or central processing unit and may be formed as one or more Application-specific integrated circuits (ASICs). Each associated electronic memory of toner cartridge 135, imaging unit 140, and fuser 145 may be a volatile memory, a non-volatile memory, or a combination thereof or any memory device convenient for use with the corresponding processing circuitry.

The electrophotographic printing process is well known in the art and, therefore, is described briefly herein. During a printing operation, charge roll 150 electrically charges an outer surface of PC member 160 to a predetermined voltage. LSU 130 then discharges a selected portion of the outer surface of PC member 160 to create a latent image on an outer surface of PC member 160. Toner may then be transferred from a toner sump behind developer roll 155 to the latent image on PC member 160 by developer roll 155 (in the case of a single component toner development system) or by a magnetic roll (in the case of a dual component toner development system, not shown) to create a toned image on PC member 160. The toned image is then transferred to a media sheet received by imaging unit 140 from a media input tray (not shown) for printing. Toner may be transferred directly to the media sheet by PC member 160 or by an intermediate transfer member that receives the toner from PC member 160. Toner remnants on PC member 160 may be removed by a waste toner removal system (not shown). The toned image is then bonded to the media sheet by fuser 145 and then sent to a media output area (not shown) in imaging device 100 or to one or more finishing options such as a duplexer, a stapler or a hole-punch attached to imaging device 100 (not shown).

TDS 165 applies particular amounts of toner (also "toner patches") onto PC member 160, calibrates a density thereof along a surface of PC member 160, and applies this calibrated density in printing toned images in media sheets. It is to be understood that no printing transpires during calibration. When there are changes in the calibrations, the amount of toner applied onto PC member 160 is also changed, adjusting the amount of toner applied from PC member 160 onto a next media sheet. Since a temperature within imaging unit 140 normally increases following a number of times that a toned image is consistently transferred onto a media sheet, printed images may turn relatively darker than when printing images immediately following a power on reset of imaging device 100 or when printing images during a time that imaging device 100 comes right out of standby or idle mode. To regularly adjust the amount of toner applied onto PC member 160 and ensure consistent print quality between media sheets, it is common for TDS 165 to be configured to perform another toner density calibration following every predetermined number of pages, e.g., 500-600 pages.

For example, when a toner density calibration is first performed following an initial power on reset (POR) of imaging device 100, PC member 160 may be in a "cold" duty cycle state. During a time that imaging device 100 has been consistently printing, PC member 160 may be in a "hot" duty cycle state. In the "hot" duty cycle state, an amount of toner applied on the media sheet would have changed from an amount of toner applied when printing immediately after the calibration. In one example, an image on the printed page may be considerably darker. As such, a default toner density set during an initial calibration may no longer guarantee consistent print quality over time, thus requiring a new toner density calibration prior reaching the page count threshold.

Figure 2:
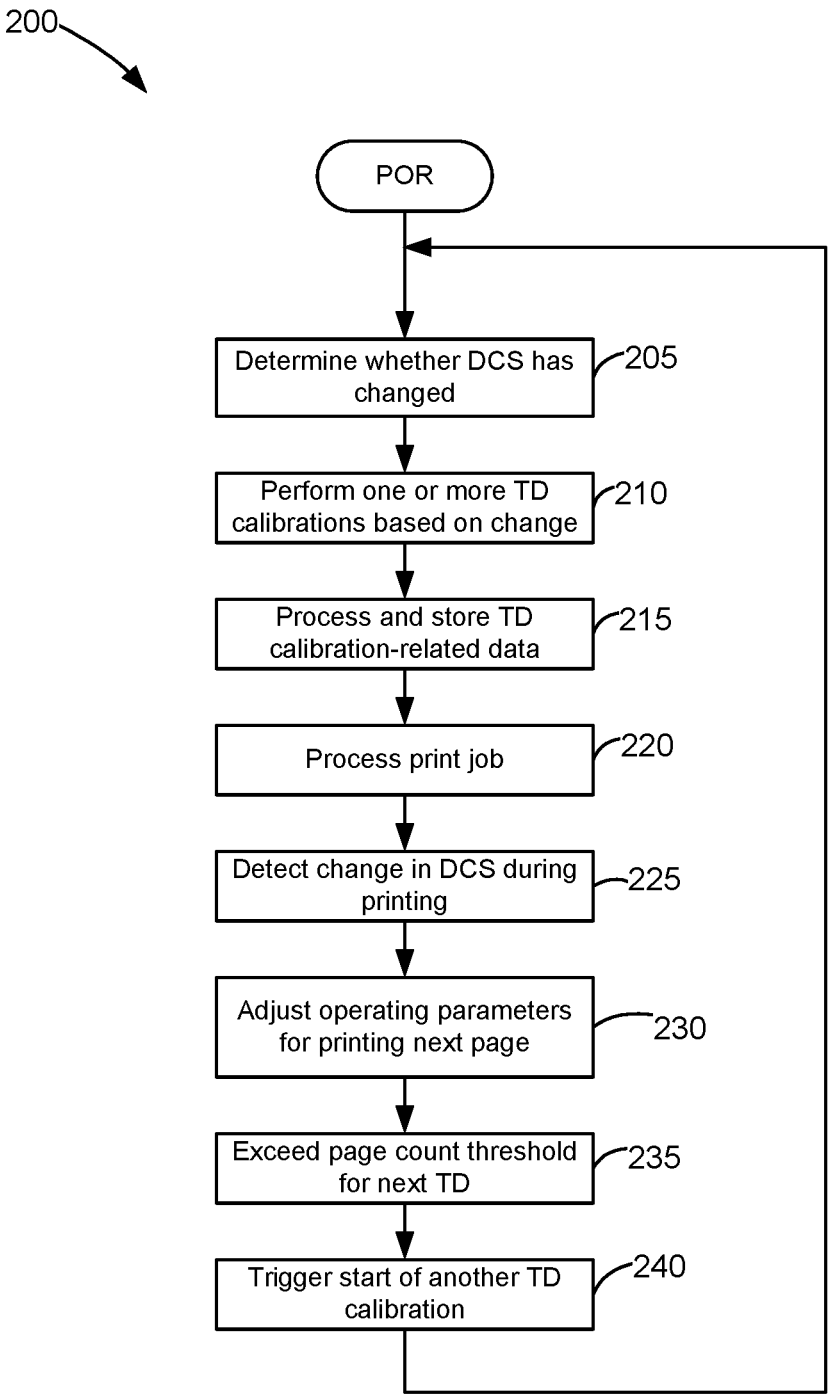
FIG. 2 is a flowchart showing an example method for adjusting toner density in the electrographic imaging device of FIG. 1.

FIG. 2 is an example method 200 for adjusting toner density in imaging device 100 of FIG. 1. Briefly, method 200 is divided into a toner density (TD) calibration process (blocks 205-215) and a parameter adjustment process (blocks 225-240).

At block 205, following a POR of imaging device 100, controller 105 determines whether a duty cycle state (referred to hereinafter and in the drawings as DCS) in imaging device 100 has changed. As discussed above, the term "duty cycle state" is referred to herein as a state of print engine 120 throughout a period of time in which imaging device 100 is being operated and print engine 120 in particular. In one example embodiment and for purposes of the present disclosure, the duty cycle state may refer to a state of PC member 160 following a predetermined period of processing print jobs (i.e., number of revolutions). Controller 105 may perform block 205 upon receipt of an instruction to start a TD calibration.

The present disclosure categorizes a duty cycle state into three states: "hot", "warm", and "cold", where:

a. "hot">R1 PC revs in last T minutes,
b. "warm">R2 PC revs in last T minutes, <=R1 PC revs in last T minutes,
c. "cold"<R2 PC revs in last T minutes, with R1 being a first predetermined number of revolutions of PC member 160 and R2 being a second predetermined number of revolutions of PC member 160 lesser than R1.

Determining whether the DCS has changed may include identifying a current duty cycle state of PC member 160; determining whether a DCS of PC member 160 from a previous TD calibration is stored in memory 110; and if so, determining whether the current DCS and the stored DCS is the same. In the present disclosure, every time a TD calibration is performed, a DCS of PC member 160 is stored in memory 110 for reference in the next TD calibration. In the context where a TD calibration has never been performed such that no DCS is stored in memory 110, controller 110 performs a full TD calibration in imaging device 100 and then stores the DCS following the calibration.

At block 210, TDS 165 performs one or more TD calibrations based on whether the DCS has changed. The one or more TD calibrations may include a solid patch TD calibration and/or a pattern patch TD calibration. In some example embodiments, a pattern patch TD calibration may be performed following a solid patch TD calibration. In other example embodiments, TDS 165 may skip a solid patch TD calibration and instead perform only a pattern patch TD calibration. As such, a full TD calibration includes both solid and pattern patch TD calibrations whereas a partial TD calibration includes a pattern patch TD calibration. A page count threshold may also affect whether or not to perform solid patch TD calibration with pattern patch TD calibration, as will be discussed in greater detail below with respect to FIG. 3.

At block 215, controller 105 processes then stores data from the one or more TD calibrations performed in block 210. TD calibration-related data may include a combined voltage index value indicating respective voltages of charge roll 150 and developer roll 155 (referred to hereinafter and in the drawings as CDDI or ChgDevDarknessIndex variable), the DCS when performing the TD calibration, and a reflection ratio of specific toner patches applied onto a surface of PC member 160 as outputted by TDS 165.

At block 220, controller 105 may process the print job following the TD calibration process from blocks 205-215. In one example embodiment, controller 105 may start processing a print job and print a first page thereof following a first TD calibration. In another example embodiment, controller 105 may continue processing succeeding pages of a print job.

At block 225, controller 105 may detect a DCS change during printing. Similar to block 205, for every page being processed, controller 105 may determine whether or not there is a change in a current DCS of PC member 160 relative to a stored DCS in memory 110 during the previous TD calibration in block 210.

At block 230, in response to the DCS change, controller 105 may adjust the set of operating parameters and apply the adjusted parameters in printing succeeding pages.

In one example embodiment, controller 105 may adjust the combined voltage index value of charge roll 150 and developer roll 155 or CDDI by adding a predetermined adder value to the CDDI value stored in memory 110, as obtained in performing the one or more TD calibrations in block 215. The predetermined adder values may be stored in memory 110. The adder value to be added on top of the current voltage index value of developer roll 155 may depend on a transition between the stored DCS (in block 215) and the current DCS (i.e., from "cold" to "hot", "warm to cold", etc.), as will be discussed in greater detail below.

In adjusting the CDDI value, an amount of toner retrieved and applied onto PC member 160 is also changed. The adjusted CDDI value will be directly applied in printing succeeding print job pages. In changing the amount of toner desired to be applied by making adjustments to the CDDI value, another TD calibration may be unnecessary.

At block 235, controller 105 may then determine whether a printed page count exceeds a predetermined threshold for performing another TD calibration, and if so, at block 240, controller 105 triggers another TD calibration. In one example aspect, controller 105 may temporarily suspend printing. In triggering another TD calibration, actions in blocks 205 to 215 are again performed such that new calibration-related data (e.g., CDDI value, stored DCS, reflection ratios) are also obtained and stored for reference in printing the succeeding pages.

In the TD calibration process at blocks 205-215, the TD calibration process is optimized by limiting the use of toner during calibration. In particular, since both types of TD calibrations are typically performed together for every calibration cycle, skipping one type of TD calibration based on an absence of change in the DCS saves toner. In the parameter adjustment process at blocks 225-240, operating parameters in printing succeeding pages are dynamically adjusted based on changes in DCS. In doing so, an amount of toner retrieved by developer roll 155 and applied onto PC member 160 is also adjusted in printing incoming pages. Additionally, where in existing art another TD calibration is set following every predetermined number of pages, the present disclosure requires TD calibrations to be made less frequently, as controller 105 depends on both changes in the DCS of PC member 160 and page count thresholds. While blocks 205-240 are shown as interconnected in FIG. 2, blocks 205-215 may be independently performed from blocks 220-240 and vice-versa.

Figure 3:
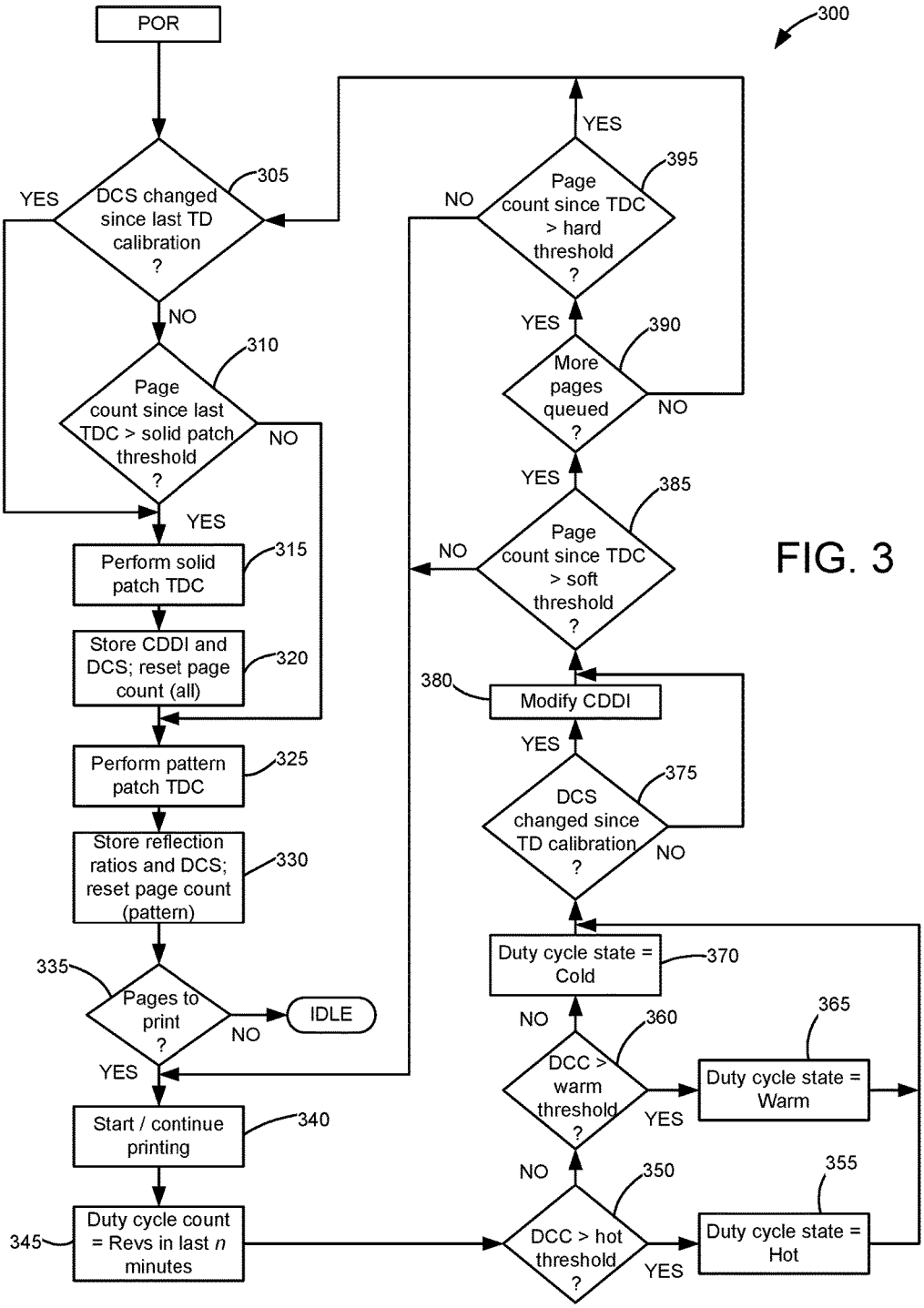
FIG. 3 is a flowchart including example methods for performing one or more toner density calibrations in the electrographic imaging device of FIG. 1.

FIG. 3 is an example method 300 for performing one or more TD calibrations in imaging device 100 of FIG. 1. It will be noted that example method 300 is an expanded or a more detailed version of example method 200 in FIG. 2. For example, blocks 305 to 330 are covered by or essentially the same as blocks 205 to 215 in FIG. 2 (TD calibration process) whereas blocks 340 to 395 are covered by or essentially the same as blocks 225 to 240 in FIG. 2 (adjustment process). Briefly, the disclosed calibration process in blocks 305 to 330 relates to skipping one type of TD calibration based on at least an absence of a DCS change while the disclosed adjustment process in blocks 345 to 395 relates to comparing a current DCS to a stored DCS and maintaining or adjusting the voltage index value of charge roll 150 and developer roll 155 as a result of the comparison.

At block 305, following POR of imaging device 100, controller 105 may determine whether there is a change in DCS from the last TD calibration. Following a period of time of processing print jobs and having no changes to the DCS of PC member 160, a darkest possible level of the image on the printed media may be achieved, such that it is unnecessary to perform both solid and pattern patch TD calibrations and to add more toner to the toned image on the media sheet. To get the same level of darkness between toned images, controller 105 may track a count of printed pages since the last TD calibration prior performing again both solid and pattern patch TD calibrations in addition to determining whether there is a DCS change. As such, at block 310, following a determination that the current DCS remained the same as the stored DCS during the last TD calibration, controller 105 may further determine whether a printed page count since the last TD calibration exceeded a predetermined page count threshold which indicates that the a full TD calibration is to be performed again.

At block 315, upon a determination that the DCS changed since last TD calibration, or in the alternative, upon a determination that the DCS remained the same since last TD calibration and that the printed page count since last TD calibration is greater than the predetermined page count threshold in block 310, TDS 165 initially performs solid patch TD calibration where a set of solid toner patches are applied onto a surface of PC member 160 to measure toner density, as will be known in the art. At block 320, controller 105 then stores a new CDDI value along with the DCS determined during the solid patch TD calibration. Additionally, controller 105 may also reset the printed page count for comparison with the threshold at block 310 following performing block 315.

At block 325, upon a determination that the DCS remained the same since last TD calibration and that the page count since last TD calibration is either less than or equal to the predetermined page count threshold from block 310, TDS 165 skips solid patch TD calibration and instead performs pattern patch TD calibration, wherein a set of patterned toner patches are applied onto a surface of PC member 160 to measure toner density. At block 330, controller 105 then stores reflection ratios as identified by TDS 165 along with the DCS during the pattern patch TD calibration. Reflection ratios may include halftone reflection ratio values (for single-function imaging devices) and halftone and stochastic reflection ratio values (for multifunction imaging devices). Additionally, controller 105 may also reset the (pattern patch) page count for comparison with the threshold at block 310.

At block 335, following performing at least one of the two types of TD calibrations above, controller 105 may then determine whether media sheet pages are available for printing. Upon a determination that no print job is in queue, imaging device 100 may be put on standby or idle mode. At block 340, upon a determination that there is at least one print job in queue in imaging device 100, controller 105 may then print a first or a next page of the print job.

At block 345, following start or continuation of the printing process, controller 105 may determine a number of revolutions made by PC member 160 (also "duty cycle count", referred to in the drawings as DCC) in the last predetermined period, such as, for example, in the last 30 minutes. Generally, determining the number of revolutions made by PC member 160 during the last predetermined period corresponds to determining a DCS of PC member 160.

Controller 105 then compares the determined number of revolutions of PC member 160 to each of the DCS state thresholds discussed above with respect to block 205 (FIG. 2) to determine a current DCS of PC drum 160.

At block 350, controller 105 may determine whether the DCC from block 345 is greater than the "hot" threshold, and if so, at block 355, stores the current DCS of PC member 160 as "hot". Otherwise, controller 105 compares the determined DCC with the warm and cold thresholds in the preceding blocks.

At block 360, upon a determination that the DCC from block 345 does not fall into the "hot" threshold to indicate a "hot" DCS, controller 105 may determine whether the DCC is greater than the "warm" threshold, and if so, stores the current DCS of PC member 160 as "warm" (block 365). Otherwise, at block 370, upon a determination that the DCC from block 345 does not fall into either the "hot" or "warm" thresholds, controller 105 stores the current DCS of PC member 160 as "cold."

At block 375, controller 105 then determines whether there is a change in DCS. In performing the determination, controller 105 may compare the new DCS identified based on the predetermined DCS thresholds (from any one of blocks 355, 365, and 370) with the DCS stored in memory 110 from a last TD calibration (at least one of blocks 315 and 330. Following a determination of controller 105 that the current DCS and a DCS in the last TD calibration is the same, controller 105 proceeds to block 385.

At block 380, following a determination that the DCS has changed relative to the DCS stored during last TD calibration, controller 105 modifies the CDDI value for consequently modifying a voltage vector between developer roll 155 and PC member 160 and then proceeds to block 385. Modifying the CDDI value may include adjusting the current CDDI value to include an adder value in order to achieve the desired voltage for retrieving toner and therefore a desired toner density. The set of adder values are stored in memory 110 of imaging device 100. Each adder value may be negative or positive in value and may depend on the level of transition between DCSs. A table showing example values to be added to the CDDI value based on the change in DCS is shown below.

| index | duty cycle state change | CDDI adder value |
|---|---|---|
| 0 | cold to warm | −3 |
| 1 | cold to hot | −3 |
| 2 | warm to cold | +3 |
| 3 | warm to hot | −3 |
| 4 | hot to warm | +3 |
| 5 | hot to cold | +15 |

Blocks 385, 390, and 395 in FIG. 3 correspond to block 235 in FIG. 2 where controller 105 keeps track of whether or not to trigger another TD calibration based upon the need after processing a plurality of pages. In the present disclosure, a "soft" page count threshold and a "hard" page count threshold greater in value than the "soft" threshold are predetermined. Both thresholds are set as a basis in triggering another full or partial TD calibration. Broadly, for every page printed, controller 105 determines a printed page count since the last TD calibration; determines whether the page count is still within the soft and hard threshold; and if so, continues printing (block 340).

In particular, at block 385, controller 105 may determine whether the page count since the last TD calibration is greater than the "soft" page count threshold. Upon a determination that the page count is less than or equal to the "soft" page count threshold, controller 105 proceeds to block 340 where a next page queued in print engine 120 may be printed.

At block 390, upon a determination that the page count is greater than the "soft" page count threshold, controller 105 may determine whether more pages are queued in print engine 120. The page(s) may either be page(s) from the same print job or page(s) from another print job.

At block 395, upon a determination that more pages are available for printing, controller 105 may then determine whether the page count since the last TD calibration is greater than the "hard" page count threshold. Upon a determination that the page count since the last TD calibration is greater than the "soft" page count threshold but is less than or equal to the "hard" page count threshold, controller 105 proceeds to block 340 where a next page queued in print engine 120 may be printed.

Otherwise, upon either a determination that no more pages are queued in print engine 120 or that the printed page count since the last TD calibration is greater than the "hard" page count threshold, controller 105 may trigger another TD calibration process and again proceed to block 305.

It will be noted that blocks 340 to 395 may be performed as long as a print job is being processed or queued in print engine 120. Using the disclosed methods above, TD calibration may not only be performed for every predetermined number of pages, but when there is also a change in the DCS. As a result of limiting the frequency of performing TD calibrations based on these two factors, toner is saved and the allowable life of imaging components and supplies of imaging device 100 are more efficiently utilized. Additionally, in skipping solid patch TD calibration when determined to be unnecessary by the present disclosure (i.e., performing block 325 following block 310), a darkness level among printed media sheets is made more consistent.

It will be appreciated that the actions described and shown in the example flowcharts may be carried out or performed in any suitable order. It will also be appreciated that not all of the actions described in FIGS. 2 and 3 need to be performed in accordance with the example embodiments and/or additional actions may be performed in accordance with other example embodiments of the disclosure.

Many modifications and other embodiments of the disclosure set forth herein will come to mind to one skilled in the art to which these disclosure pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of printing in an imaging device, comprising:
- setting a default toner density for printing;
- developing a first toned image having the default toner density;
- printing the first toned image on a first page of a print job; and
- before printing a second page of a print job:
  - determining whether a duty cycle state of a photoconductive member in the imaging device has changed; and
  - upon a positive determination, developing a second toned image having a toner density derived from the default toner density and printing the second toned image on the second page.

2. The method of claim 1, wherein a darkness level of the first toned image on the first page and a darkness level of the second toned image on the second page is the same.

3. The method of claim 1, wherein the setting the default toner density for printing includes performing one of a full toner density calibration and a partial toner density calibration to set the default toner density.

4. The method of claim 1, further comprising, prior developing the second toned image and upon a determination that the duty cycle state has changed, determining whether a page count in the imaging device is within a predetermined threshold and upon a positive determination, developing the second toned image using the toner density derived.

5. The method of claim 4, wherein, upon the determination that the page count in the imaging device exceeds the predetermined threshold, performing another toner density calibration to set a new default toner density.

6. The method of claim 1, wherein the determining whether the duty cycle state has changed includes comparing a current duty cycle state to a stored duty cycle state in the imaging device, the stored duty cycle state obtained when setting the default toner density.

7. The method of claim 6, further comprising, following a determination that the duty cycle state of the photoconductive member in the imaging device has changed, deriving the toner density by adding a predetermined value to a voltage index used in achieving the default toner density, the predetermined value being based on the current duty cycle state and the stored duty cycle state.

8. An electrophotographic imaging device including a toner density sensor and having a non-transitory computer-readable medium containing instructions for a method of printing, the method comprising:

determining a default toner density;

printing a first print job page having a toned image developed by applying the default toner density; and for each print job page following the first print job page:

detecting a change in a duty cycle state of a photoconductive member in the imaging device;

adjusting the default toner density in response to the change in the duty cycle state; and printing an image associated with a next print job page developed using the adjusted toner density.

9. The imaging device of claim 8, wherein no toner density calibration method is performed in adjusting the default toner density in response to the change in the duty cycle state.

10. The imaging device of claim 8, wherein the determining the default toner density includes performing one of a full toner density calibration and a partial toner density calibration, and wherein the full toner density calibration includes a solid patch calibration and a pattern patch calibration and the partial toner density calibration includes the pattern patch calibration.

11. The imaging device of claim 10, further comprising storing a duty cycle state of the photoconductive member in performing the one of the full toner density calibration and the partial toner density calibration.

12. The imaging device of claim 10, further comprising storing a combined voltage index of a developer roll and a charge roll after performing the one of the full toner density calibration and the partial toner density calibration to achieve the default toner density.

13. The imaging device of claim 12, wherein the adjusting the default toner density includes adding a predetermined value to the combined voltage index to adjust a density of toner in developing an image based on the change in the duty cycle state.

14. The imaging device of claim 8, further comprising, following the adjusting of the default toner density, determining whether a page count of printed pages exceeds a predetermined threshold and continue printing the image upon a negative determination.

15. The imaging device of claim 14, wherein upon a determination that the page count of printed pages exceeds the predetermined threshold, postponing printing the image and performing a toner density calibration for setting a new default toner density.

16. An imaging system for an electrophotographic image forming device, including:

a controller;

a photoconductive member, coupled to the controller, for receiving one or more toned images; and a toner density sensor positioned adjacent to the photoconductive member for providing feedback to the controller regarding a toner density to be used in developing the one or more toned images, wherein the controller includes instructions to:

set a first toner density for printing a first page of a print job;

detect a change in a duty cycle state of the photoconductive member prior printing each page succeeding the first page of the print job;

derive a second toner density from the first toner density in response to the change in the duty cycle state; and apply the second toner density in developing a toned image associated with each page based on the change in the duty cycle state.

17. The imaging device of claim 16, wherein the instructions to set the first toner density includes instructions to perform one of a full toner density calibration and a partial toner density calibration.

18. The imaging device of claim 17, wherein the instructions to detect the change in the duty cycle state of the photoconductive member is relative to a duty cycle state when performing the one of the full toner density calibration and the partial toner density calibration.

19. The imaging device of claim 17, wherein the controller further includes instructions to determine whether an image for printing is queued in the imaging device prior applying the second toner density, and upon a negative determination, to again perform one of a full toner density calibration and a partial toner density calibration and set a new toner density.

20. The imaging device of claim 16, wherein the controller further includes instructions to:

determine whether a printed page count since a time that the first toner density is set exceeds a predetermined page count threshold; and set another first toner density for printing prior performing the instructions to detect the change in the duty cycle state upon a determination that the printed page count exceeds the predetermined page count threshold.

* * * * *